US005571005A

United States Patent [19]

Stoll et al.

[11] Patent Number: 5,571,005

[45] Date of Patent: Nov. 5, 1996

[54] HINGED VANE ROTARY PUMP

[75] Inventors: Thomas D. Stoll, Grand Rapids; William J. Bohr, Kentwood, both of Mich.

[73] Assignee: Delaware Capital Formation, Inc., Wilmington, Del.

[21] Appl. No.: 479,676

[22] Filed: Jun. 7, 1995

[51] Int. Cl.[6] ..... F04C 2/38

[52] U.S. Cl. ..... 418/268

[58] Field of Search ..... 418/267, 268, 418/234

[56] References Cited

U.S. PATENT DOCUMENTS

| | | | |
|---|---|---|---|
| 156,814 | 11/1874 | Peck | 418/268 |
| 802,768 | 10/1905 | Mears | 418/268 |
| 823,020 | 6/1906 | Allan | 418/268 |
| 4,765,185 | 8/1988 | Lew | 418/268 |
| 4,846,638 | 7/1989 | Pahl et al. | 418/268 |
| 4,960,371 | 10/1990 | Bassett | 418/268 |

FOREIGN PATENT DOCUMENTS

| | | | |
|---|---|---|---|
| 1030916 | 3/1983 | France | 418/268 |
| 2754288 | 6/1978 | Germany | 418/268 |
| 3338969 | 5/1985 | Germany | 418/267 |

*Primary Examiner*—John J. Vrablik
*Attorney, Agent, or Firm*—Warner, Norcross & Judd

[57] ABSTRACT

A hinged vane rotary pump including a cylindrical chamber, a rotor eccentrically mounted within the chamber, and a plurality of vanes. Each vane is hinged for pivoting movement at its approximate middle to balance hydraulic pressure across the face of the vane. The balanced pressure reduces the force applied by the vane against the chamber liner and therefore reduces wear. As one end of each vane wears against the chamber liner during operation, the axis effectively moves to the center of the vane. Preferably, stops are provided to limit movement of the vanes after maximum wear has occurred.

23 Claims, 5 Drawing Sheets

HINGED VANE ROTARY PUMP

BACKGROUND OF THE INVENTION

The present invention relates to pumps, and more particularly, to positive-displacement rotary vane pumps.

Rotary vane pumps operate through the action of a number of rotating vanes or blades. A conventional rotary vane pump includes a rotor assembly eccentrically positioned within a pumping chamber. A number of vanes are spaced around the rotor to divide the pumping chamber into a series of cavities. As the rotor rotates, these cavities rotate around the pumping chamber continually changing in volume due to movement of the vanes and the eccentric alignment of the rotor and pumping chamber. An inlet communicates with the pumping chamber on the side of the pump where the cavities expand. Similarly, an outlet communicates with the pumping chamber on the side of the pump where the cavities contract. As each cavity expands, a partial vacuum is created to draw fluid into the pump through the inlet. As the cavity contracts, the pressure within the cavity increases forcing the fluid out of the pump through the outlet. The expansion and contraction process continues for each cavity to provide a continuous pumping action.

Most rotary vane pumps can be broadly classified in one of two categories—sliding vane and hinged vane. Sliding vane rotary pumps include generally straight vanes slidably fitted within radially extending slots formed in the rotor. As the rotor spins, centrifugal force and hydraulic pressure maintain the vanes in firm contact with the liner of the pumping chamber. However, shear force in the vane slot resists the sliding movement of the vanes. With relatively viscous pumpage, the shear force may cause the vanes to stick within the vane slots.

Hinged vane rotary pumps include vanes that are pivotally secured to the rotor (See FIG. 1 and U.S. Pat. No. 4,960,371, issued Oct. 2, 1990, to Bassett). The vanes 200 include an inner end 202 hinged to the rotor 204 and an outer end 206 in contact with the liner 208 of the pumping chamber. As the rotor 204 spins, the centrifugal force and hydraulic pressure of the pumpage urge the vanes 200 outward against the liner 208. Unlike sliding vanes, hinged vanes are not adversely affected by shear force. In fact, because the vanes are angled into the direction of rotation, shear force actually helps to push the vanes outward into firm contact with the liner.

Hinged vane rotary pumps also have a larger per revolution pumping capacity than conventional sliding vane pumps of the same housing and rotor dimensions. The pumping capacity of a rotary pump is dependant in part on the maximum volume of each pumping cavity. The volume of a pumping cavity in a sliding vane rotary pump is defined by the inner surface of the liner, the outer surface of the rotor, and the opposing surfaces of the bounding vanes. Hinged vane rotary pumps, on the other hand, include vane pockets that seat the vanes as they fold inward. When the vanes fold outward, these pockets are open to receive pumpage, thereby significantly increasing the capacity of the pump.

Hinged vanes are, however, relatively susceptible to wear. As the vanes rotate, the outer ends are in virtually continuous contact with the liner of the pumping chamber, causing both the vane tips and the liner to wear. Eventually, the liner and vanes must be replaced. Vane wear can also severely damage the pump. As the vanes wear, they pivot farther outward. The hydraulic pressure applied across the entire face of the vane acts to pivot the vane outward. Over time, the vanes can pivot outward far enough and/or under sufficient hydraulic force to bind against the liner, causing the pump to seize in a manner similar to a sprag clutch.

SUMMARY OF THE INVENTION

The aforementioned problems are overcome by the present invention wherein each vane in a hinged vane rotary pump is hinged at a central portion of the vane. This hinge location better balances the hydraulic pressure on the face of the vane across the hinge point.

The pump incorporating the present invention includes a rotor having a number of vanes pivotally mounted within a corresponding number of vane pockets. Each vane pivots about a hinge point located at the approximate middle of the vane. The vane pockets are shaped to allow the pumpage to engage the entire face of the vane.

Preferably, the hinge point is slightly inward from the middle of the vane so that, when the vane is worm to the design limit, the pins are located at the middle of the worn vane. Further preferably, limiting pins are located in each pocket to prevent a worn vane from pivoting outwardly beyond a design angle where they can bind against the liner.

The present invention reduces wear on the vane tips and liner of the pumping chamber by balancing the hydraulic pressure across the hinge point and thereby reducing the pressure of the vane tip against the liner.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
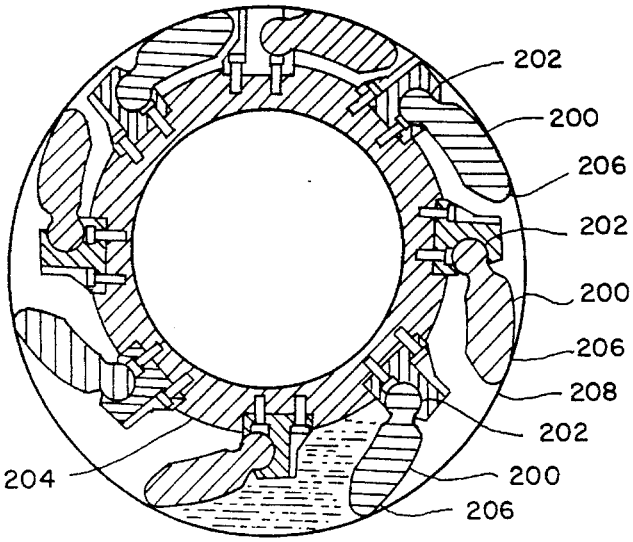
FIG. 1 (PRIOR ART)
FIG. 1 is a sectional view of a prior art hinged vane rotary pump.
Figure 2:
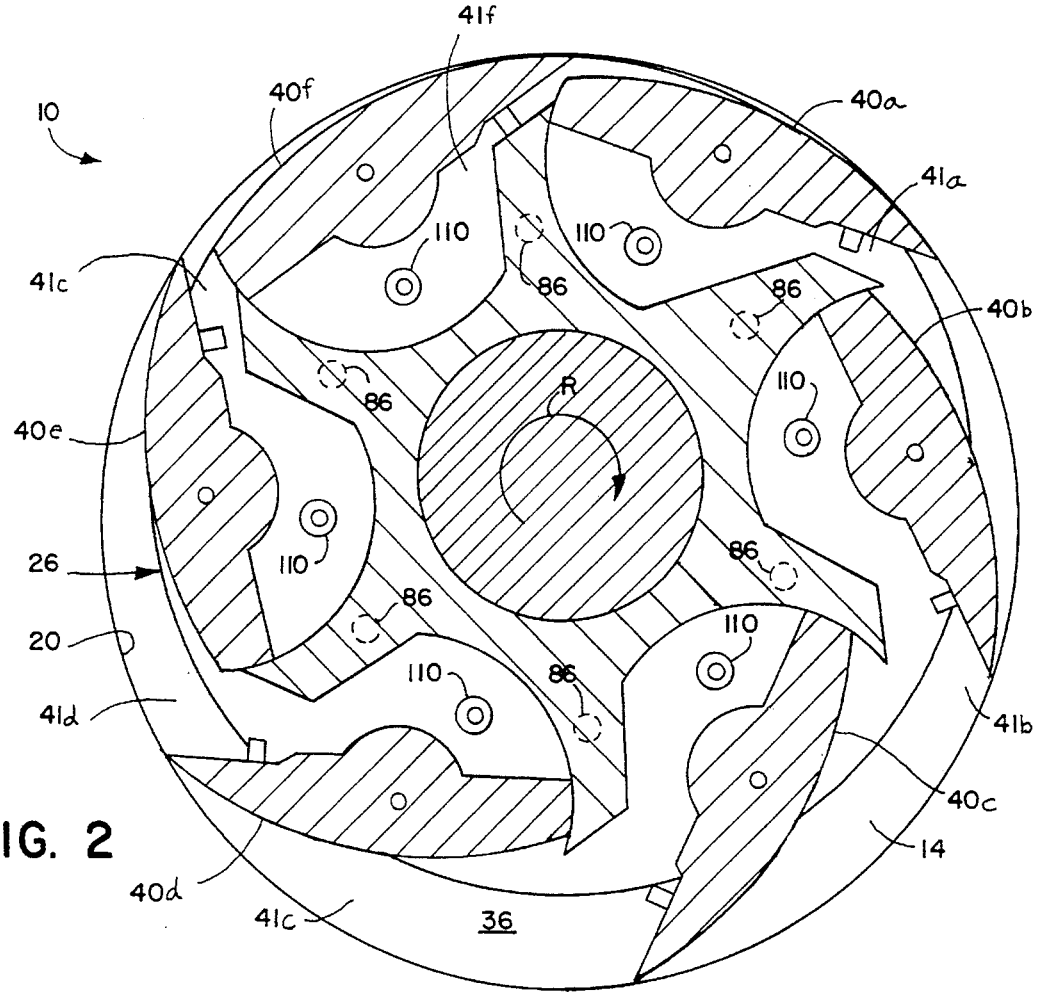
FIG. 2 is a sectional view of the rotor assembly of the hinged vane rotary pump of the present invention.
Figure 3:
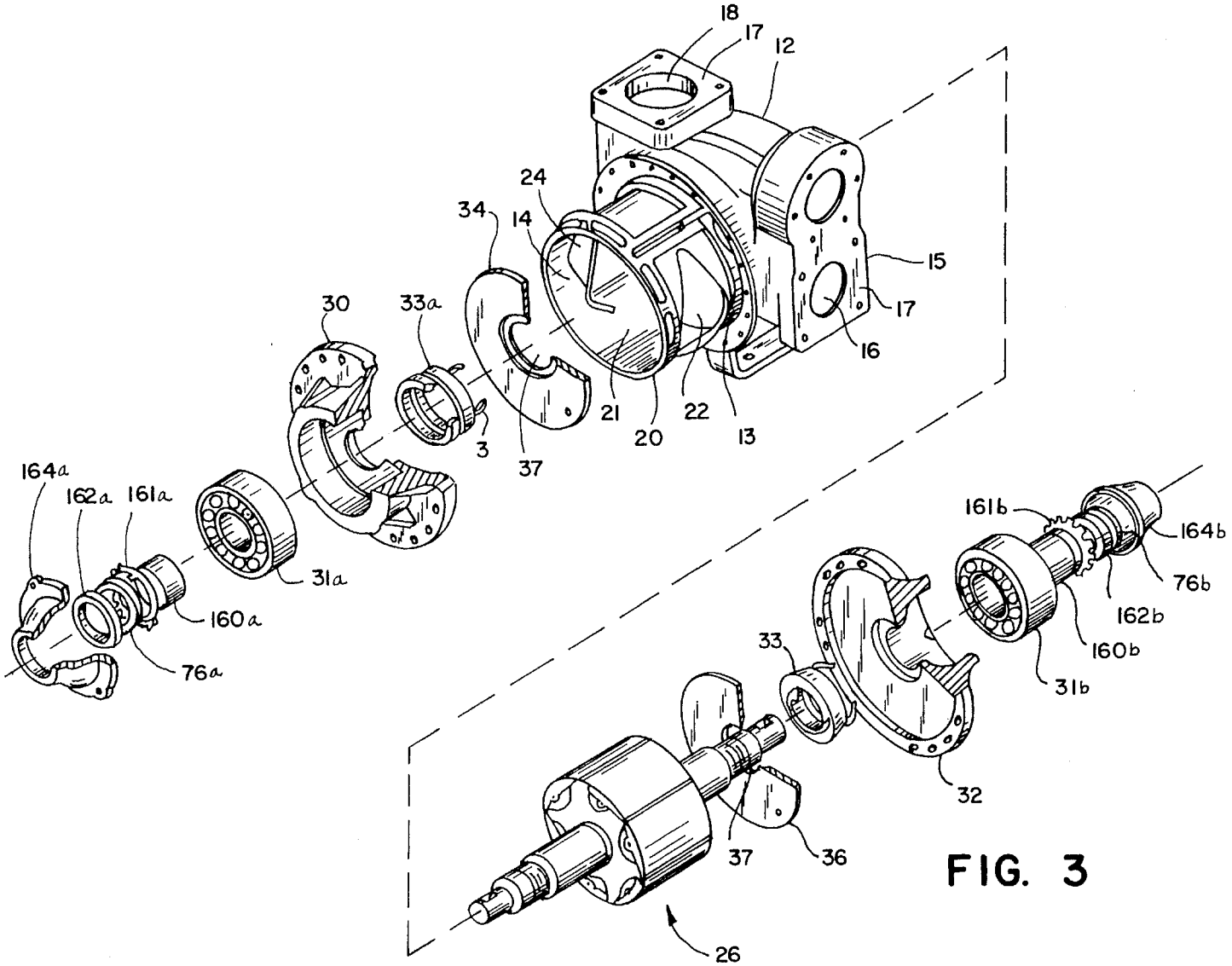
FIG. 3 is a partially exploded perspective view of the pump.

A hinged vane rotary pump according to a preferred embodiment of the invention is illustrated in FIGS. 2 and 3, and generally designated 10. By way of disclosure, and not by way of limitation, the present invention is described in conjunction with a generally conventional pump assembly. Those skilled in the art will readily appreciate and understand that the present invention is equally well suited for use with other pump assemblies.

In general, pump 10 includes a pump housing 12 rotatably supporting a rotor assembly 26. An external drive means (not shown) is coupled to the rotor assembly 26 to drive the pump 10 by rotating the rotor assembly 26. A variety of drive means are generally well know to those skilled in the art, and consequently they will not be described in detail. However, as an example, the pump may be driven by an electric or hydraulic motor and pulley assembly (not shown). Conventional input and output lines (not shown) are connected to the pump to convey the pumpage. When the pump operates, pumpage is drawn into the pump through the input line and forced out of the pump through the output line.

The pump housing 12 is generally conventional and includes an outer wall 15 defining a generally cylindrical chamber 13. Inlet 16 and outlet 18 (FIG. 3) extend through the outer wall 15 to communicate with void 13. A mounting surface 17 is defined around inlet 16 and outlet 18 to receive the input and output lines (not shown). The pump housing 12 can be manufactured to receive a variety of optional components, such as pressure gauges and the like.

A pair of liner end discs 34 and 36 close the pumping chamber 14. A liner 20 is fitted within the chamber 13 to provide a replaceable wear surface. Inlet and outlet openings 22 and 24 (FIG. 3) extend through opposite sides of the liner 20 to communicate with inlet 16 and outlet 18, respectively. The liner end discs 34 and 36 each include a concentric opening 37 to receive and rotatably support shaft 50 of the rotor assembly 26 as described below.

The rotor assembly 26 is supported eccentrically within the pumping chamber 14 by conventional heads 30 and 32. The heads are bolted directly to the pump housing 12 to secure the rotor assembly 26, liner 20, and liner end discs 34 and 36 within the chamber 13. Each head 30 and 32 is fitted with a conventional bearing assembly 31*a–b* to rotatably support opposite ends of the rotor assembly 26. A pair of conventional mechanical seals 33*a–b* are interposed between the rotor assembly 26 and heads 30 and 32 to seal the pumping chamber 14.

FIG. 2 is a cross section of a portion of the pump 10 showing the interrelationship of liner 20, pumping chamber 14, and rotor assembly 26. As illustrated, the rotor assembly 26 is eccentrically disposed within the pumping chamber 14. The direction of rotation of the rotor is denoted by arrow R. During rotation, the vanes 40*a–f* pivot inwardly and outwardly to firmly engage liner 20 and divide the pumping chamber 14 into a number of discrete cavities 41*a–f*. These cavities 41*a–f* rotate with the rotor constantly changing in volume due to the pivoting vanes and the eccentric alignment between the rotor assembly 26 and the pumping chamber 14. In general, cavities 41*a–f* have an expanding volume as they travel through the inlet side 42 of the pumping chamber 14 and a contracting volume as they travel through the outlet side 44 of the pumping chamber 14. When the cavities 41*a–f* expand, a partial vacuum is created to draw pumpage into the pumping chamber 14 through inlet 16. As the cavities move to the outlet side 44 of the pumping chamber 14, they decrease in volume forcing the pumpage out of the pumping chamber 14 through outlet 18.

Figure 4:
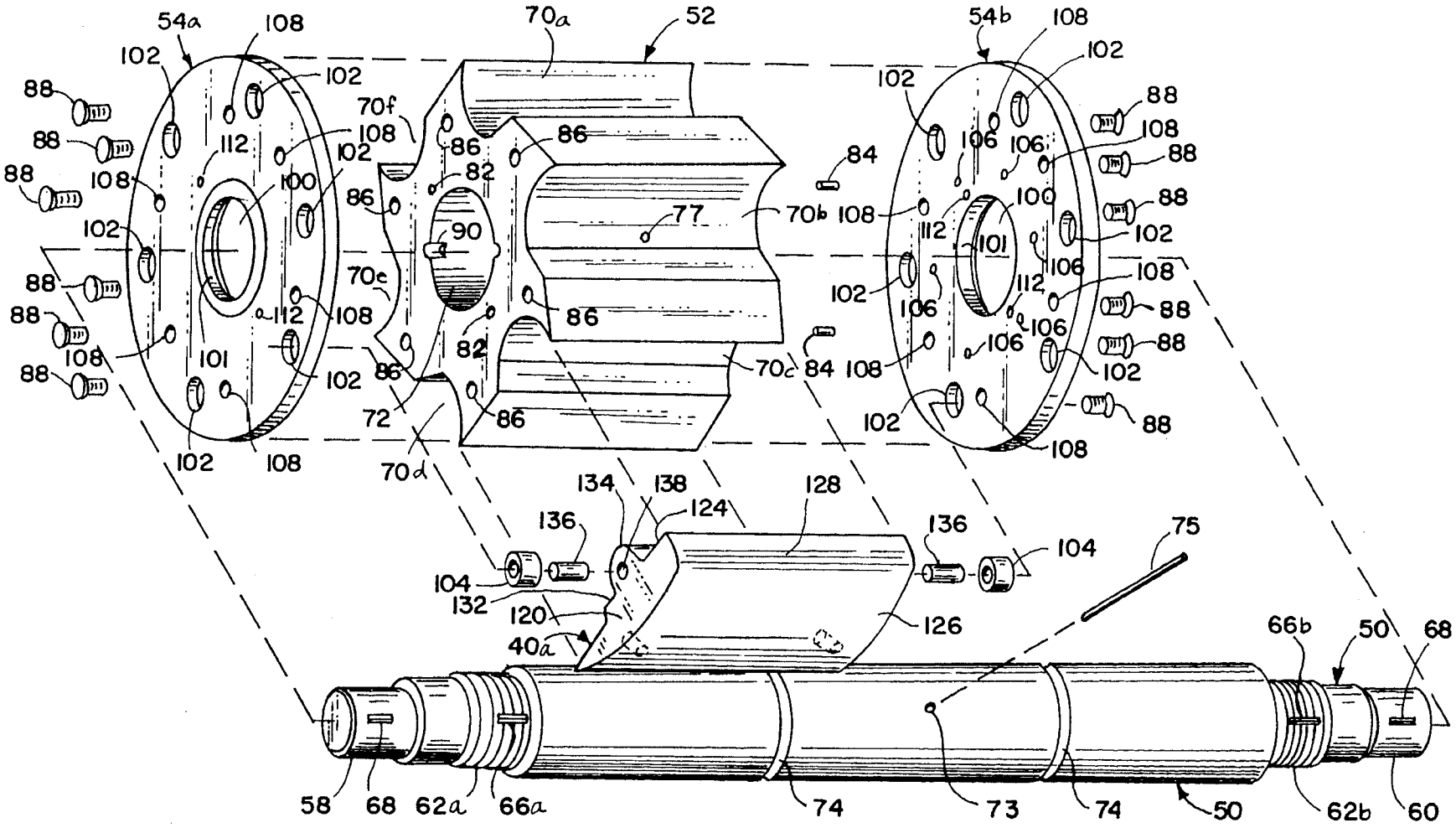
FIG. 4 is an exploded view of the rotor assembly showing only one vane.

Referring also to FIG. 4, the rotor assembly 26 generally includes a shaft 50, a rotor 52, a pair of end discs 54*a–b*, and a plurality of vanes 40*a–f*. Shaft 50 is a generally conventional rotor shaft having opposite ends 58 and 60 that, when assembled, protrude from opposite sides of the pump housing 12. Bore 73 extends transversely through the center of shaft 50 to receive a shaft pin 75 for intersecuring shaft 50 and rotor 52. A pair of annular recesses 74 extend around the shaft at the desired location of end discs 54*a–b*. The shaft 50 also includes threaded portions 62*a–b* located toward opposite ends of the shaft 50 to receive a pair of conventional locknuts 76*a–b*. The locknuts 76*a–b* secure shaft 50 in position within the pump housing 12. A keyway 66*a–b* is formed at each threaded portion 62*a–b*. Additional keyways 68*a–b* are formed at opposite ends of the shaft 50 to allow the shaft to be keyed to a conventional drive means (not shown).

Rotor 52 is preferably a one-piece machined component that fits over shaft 50 and is fixedly secured thereto. In cross section, rotor 52 generally resembles a star. Rotor 52 defines a concentric, longitudinal bore 72 to slidably fit over shaft 50. Rotor 52 also defines a traverse bore 77 to receive shaft pin 75. A series of six radially symmetric vane pockets 70*a–f* are formed around the circumference of rotor 52 to seat vanes 40*a–f*. The shape and location of the vane pockets 70*a–f* will vary depending on the design of the pump and the shape of the vanes. However, in a preferred embodiment, each vane pocket 70*a–f* includes a cup portion 78 defined by a longitudinally extending arcuate trough. The diameter of cup portion 78 is preferably selected to provide just enough clearance for the hinged vane to pivot freely. Each vane pocket 70*a–f* also includes a planar portion 80 for engaging the vane stop pins 152 as described below. Connecting portion 79 extends between cup portion 78 and planar portion 80.

Figure 5:
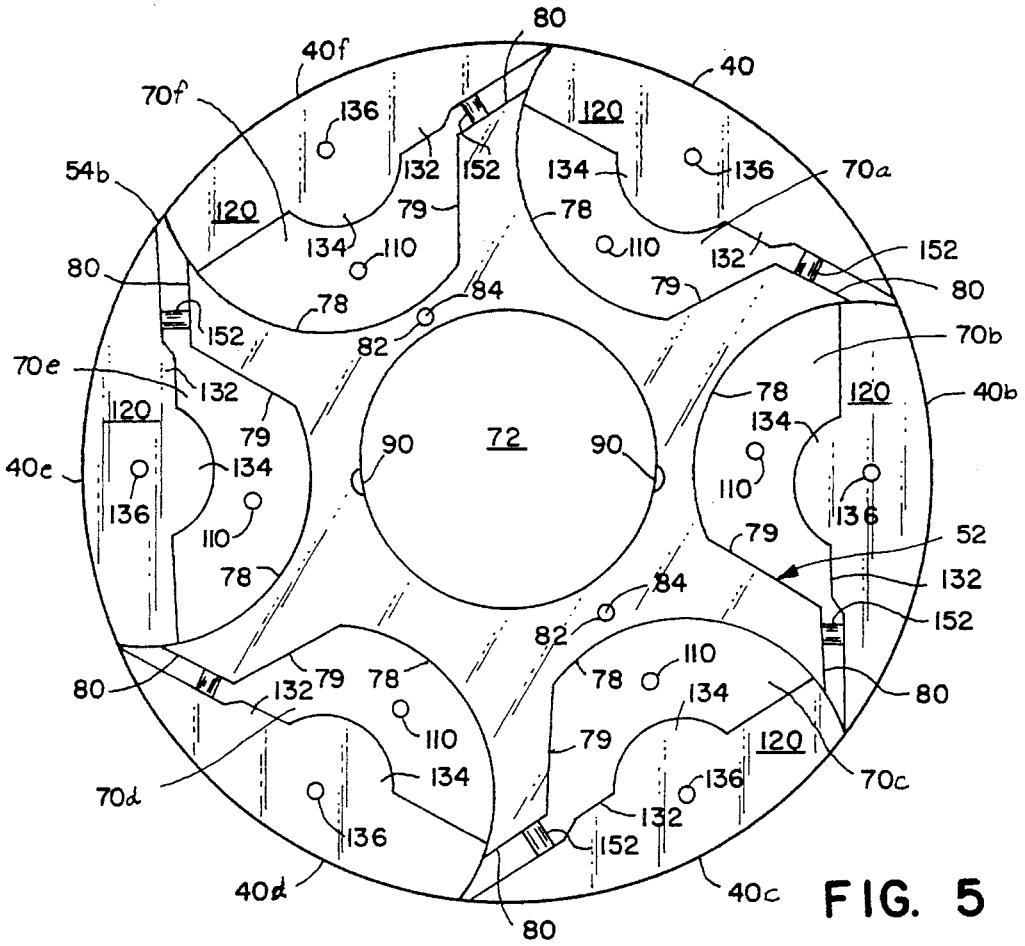
FIG. 5 is a top plan view of the rotor assembly with all of the vanes retracted.

A plurality of end disc mounting holes 86 are defined in the top and bottom surfaces of the rotor 52 (see FIG. 5). Rotor 52 preferably includes six radially symmetric mounting holes 86 adapted to receive six cap screws 88 extending through end discs 54*a–b*. A pair of radially symmetric bores 82 are also preferably defined in the top and bottom surfaces of the rotor 52 to firmly seat interlock dowels 84. When seated, interlock dowels 84 protrude slightly from the rotor 52 to engage and interlock with end discs 54*a–b*. In addition, a pair of arcuate keyways 90 are located in the top and bottom surfaces of rotor 52 to receive tangs 35 that lock the mechanical seal 33*a–b* to rotor 52.

End discs 54*a–b* are concentrically mounted to the top and bottom surfaces of rotor 52 by cap screws 88 extending through mounting holes 108. The mounting holes 108 correspond in size and location with the rotor mounting holes 86, and are preferably countersunk. The two end discs 54*a–b* are preferably identical to one another and each defines a concentric bore 100 to fit over shaft 50. The internal diameter of bore 100 is preferably larger than the outside diameter of shaft 50 to allow the tangs 35 of the mechanical seal 33*a–b* to extend therethrough to engage keyways 90. In addition, a recess 101 is defined circumferentially around bore 100 to receive a portion of the body of mechanical seal 33*a–b*. Each end disc also defines a series of bushing seats 102 to receive hinge bushings 104. The bushing seats 102 are concentrically aligned with the cup portions 78 of the vane pockets. In addition, a pair of interlock holes 112 are defined in each end disc to receive interlock dowels 84.

Further, a plurality of limit pin mounting holes 106 are defined in each end disc 54*a–b*. A limit pin 110 is seated in each limit pin mounting hole 106 to limit the outward pivot of the corresponding vane. The limit pins 110 and mounting holes 106 are preferably threaded. In general, each limit pin 110 will be located in the cup portion 78 of the corresponding vane pocket. However, the specific location of the pin 110 within the vane pocket will vary depending on diameter of the pin 110, the vane wear limit, and the shape of the vane. Alternatively, the limit pins can be mounted to the rotor or be eliminated by modifying the shape of the vane pockets to limit outward pivot of the vanes.

Figure 6:
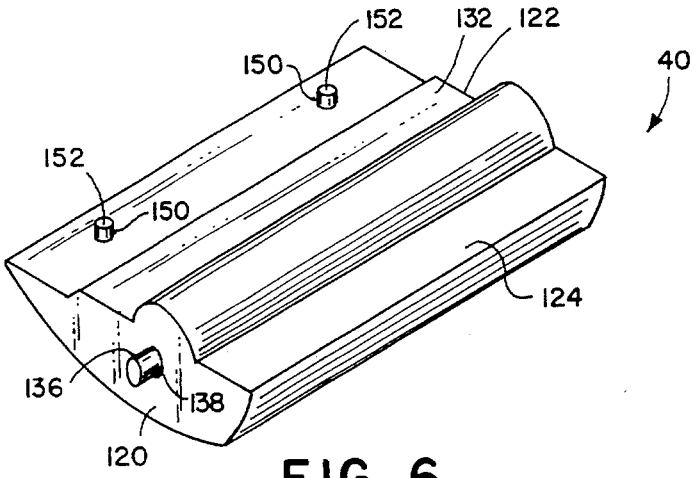
FIG. 6 is a perspective view of a vane.
Figure 7:
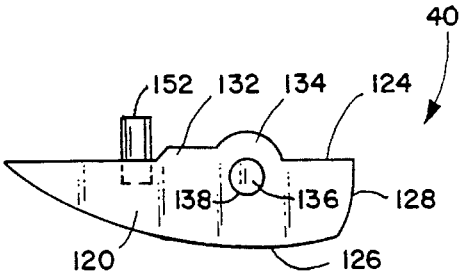
FIG. 7 is an end elevational view of the vane.

Referring now to FIGS. 6 and 7, each vane 40 preferably includes top 120, bottom 122, front 124, back 126, and end 128 surfaces. Top and bottom surfaces 120 and 122 are generally planar and extend parallel to each other. Front surface 124 is generally planar and is oriented to extend parallel to planar portion 80 of the vane pocket when the vane is completely folded into the pocket. An arcuate support portion 134 extends longitudinally across front surface 124 to bolster the vane against the forces exerted on hinge pins 136. A ridge 132 extends along support protrusion 134 to provide sufficient metal to balance the vane when it has reached its wear limit. Back surface 126 is generally arcuate and is shaped to match the curvature of end discs 54*a–b* when the vane is completely folded into the pocket. End surface 128 is also generally arcuate. The curvature of the end surface 128 preferably corresponds with the curvature of the cup portion 78 of the vane pocket.

Figure 8:
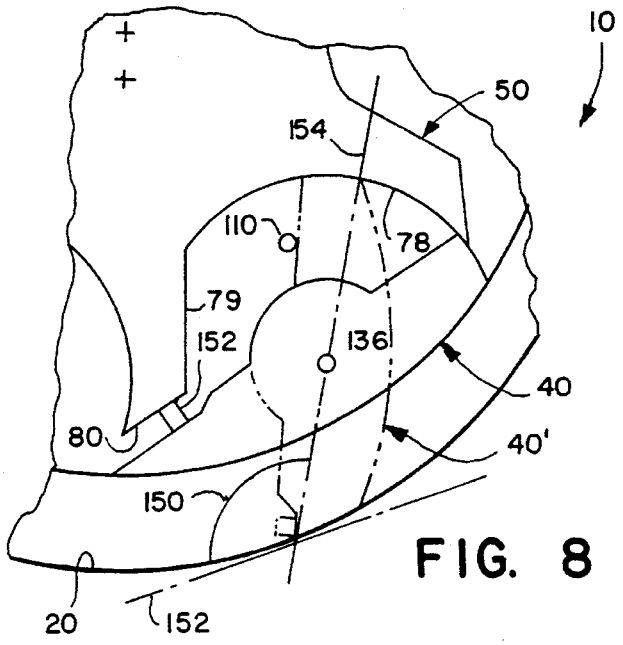
FIG. 8 is a fragmentary, sectional view of a portion of the rotor showing an unworn vane in the retracted position and showing in phantom a worn vane in the expanded position.
Figure 9:
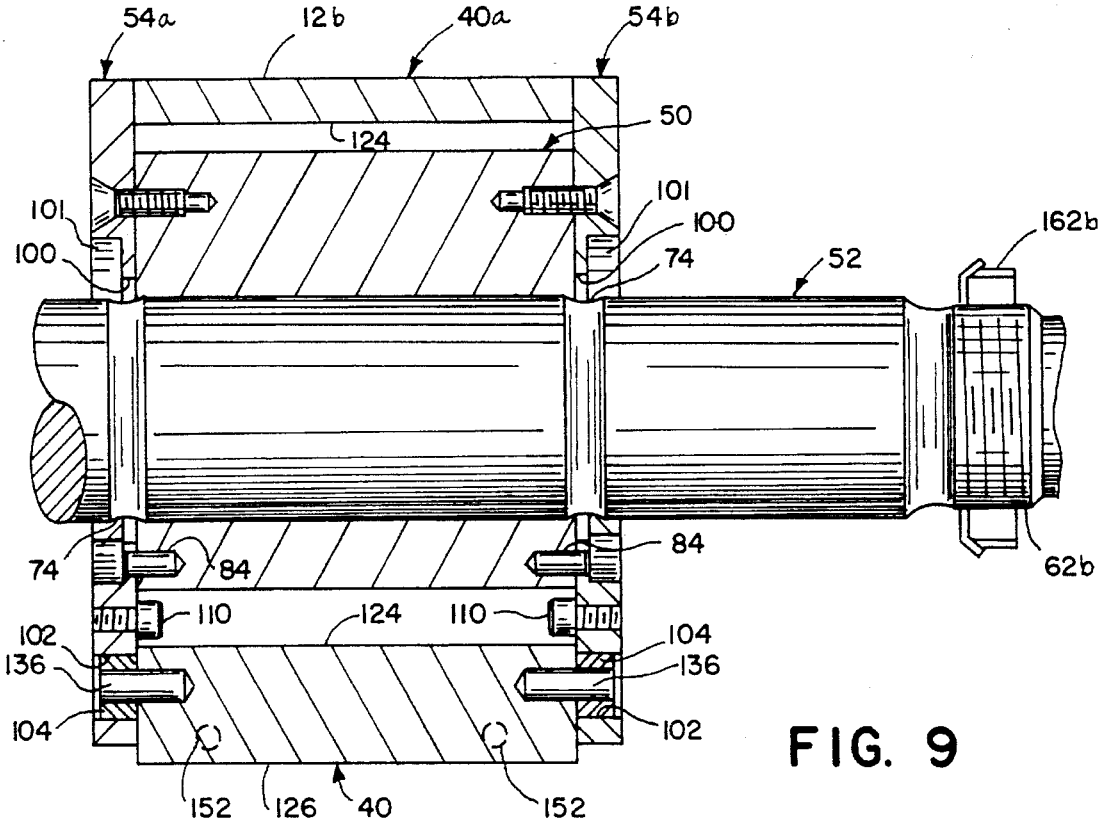
FIG. 9 is a longitudinal, sectional view of the rotor assembly.

A hinge pin bore 138 is defined in the top and bottom surfaces of each vane 40*a–f* at the axis of rotation. As noted above, the axis of rotation preferably corresponds with the center of cup portion 78 and support protrusion 134. Each vane has an inner portion having an edge and an outer portion having an edge. The axis of rotation is closer to the inner portion than to the outer portion. A hinge pin 136 is fitted within each bore 138 to pivotally interlock the vanes between end discs 54*a–b*. The location of bores 138, and consequently hinge pins 136, will be described with reference to FIG. 8. In general, the hinge pins 136 are positioned at the center of the vane when the vane reaches its wear limit. FIG. 8 shows a new vane 40 in solid lines and a worn vane 40' in phantom lines. When the vane is new, hinge pins 136 are offset from the middle of the blade toward the unworn end surface 128. As the vane wears through use, its length is reduced causing the hinge pins to "center" on the vane 40. The wear limit of the vane is reached when front surface 124 engages limit pins 110. At this point, outward pivoting and consequently further wear of the vanes is prevented. The wear limit is set to prevent the vanes from pivoting outward to the point where they bind against liner 20. The limit pins 110 are preferably located to prevent the angle 150 between tangent line 152 and imaginary line 154 (extending between the tip of the vane and the center of the hinge pins) from exceeding 120 degrees.

A pair of stop pin bores 150 extend into front surface 124 to seat a pair of stop pins 152. The stop pins 152 limit inward rotation of the vanes to maintain a gap between front surface 124 and planar portion 80 of vane pocket 70*a–f* (see FIGS. 2 and 5). Stop pins 150 are preferably dimensioned to maintain a parallel relationship between front surface 124 and planar portion 80. Alternatively, the stop pins 150 can be mounted to planar portion 80.

Assembly and Operation

Pump 10 is assembled in a generally conventional manner. Consequently, only the steps specific to this invention will be described in detail. The various components of the pump are manufactured using conventional methods or are purchased from well known suppliers.

The rotor assembly 26 is assembled by first installing interlock dowels 84 in opposite ends of rotor 52 and securing rotor 52 to shaft 50 by shaft pin 75. Next, limit pins 110 and bushings 104 are secured to both end discs 54*a–b*, and one of the end discs is secured to rotor 52 by cap screws 88.

Vanes 40*a–f* are assembled by inserting a hinge pin 136 into each hinge pin bore 138 and a stop pin 152 into each stop pin bore 150. The assembled vanes 40*a–f* are then fitted into the vane pockets 70*a–f* with the appropriate hinge pin 136 seated in bushing 104. Once all of the vanes 40*a–f* are properly positioned, the second end disc is mounted to rotor 52 by cap screws 88. The free hinge pin 136 is seated in the appropriate bushing 104 of the second end disc. Both end discs 54*a–b* are positioned so that the interlock dowels 84 engage interlock holes 112.

The pump housing 12 is assembled by inserting liner 20 into pump chamber 13. Typically, liner 20 will be keyed to prevent rotation within chamber 13. Conventional flanges (not shown) can be mounted to mounting surfaces to allow conventional input and output lines (not shown) to attach to the pump housing. A variety of optional components can be mounted to the pump housing 12, such as pressure gauges and the like.

The rotor assembly 26 is eccentrically positioned in pumping chamber 14 and end closure discs 34 and 36 are fitted over opposite ends of shaft 50. The end closure discs 34 and 36 cooperate with liner 20 to entrap the rotor assembly 26. Mechanical seals 33 are fitted over opposite ends of shaft 50 outside end closure discs 34 and 36. The tangs of each mechanical seal 33 extend through bore 100 to engage keyways 90 in rotor 52.

Next, heads 30 and 32 are fitted over opposite ends of shaft 50 and bolted directly to pump housing 12. Each head is fitted with a conventional bearing assembly 31. The bearing assemblies 31 are secured in place by a spacer *a–b*, a lock washer 161*a–b*, and a lock nut 76*a–b* fitted over shaft 50. A grease seal 162*a–b* and bearing cover 164*a–b* are also fitted over opposite ends of shaft 50 and bolted directly to the corresponding head 30 and 32.

The limit pins 110 prevent the vanes from pivoting outward to a point at which they bind against liner 20. The limit pins 110 are threadedly secured in the limit pin mounting holes 106 formed in each end disc. As the vanes wear over time, they pivot farther outward. Eventually, front surface 124 engages the limit pins 106 to limit the outward pivot of the vanes.

The central location of the hinge pins 136 reduces wear on vanes 40*a–f* and liner 20. In operation, the pumpage creates hydraulic pressure in cavities 41*a–f*. The hydraulic pressure acts against the front surface 124 of the vanes 40*a–f* forcing them to pivot outward against liner 20. Because vanes 40*a–f* pivot about the middle, the hydraulic pressure inward from the hinge pins 136 works against the hydraulic pressure outward of the hinge pin 136 to balance the pressure on either side of the hinge pins. As a result, the net outward force on vane 40*a–f* is reduced. The reduction in outward force reduces wear of both vanes 40*a–f* and liner 20.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

We claim:

1. A rotary pump, comprising:

a pumping chamber;

a rotor eccentrically positioned within said pumping chamber, said rotor defining a plurality of vane pockets and having a direction of rotation;

a plurality of vanes pivotally mounted on said rotor each within one of said vane pockets, each of said vanes having an inner edge, an outer edge, and a middle portion between said edges, each of said vanes being hinged to pivot about an axis extending through said middle portion and being oriented to fold into said direction of rotation when folding into the associated pocket, each of said vanes further including a front surface extending from said inner edge to said outer edge, said vane pockets shaped to allow pumpage to engage substantially all of said front surface at all points of revolution of said rotor.

2. The pump of claim 1 wherein said axis for each of said vanes is closer to said inner edge than to said outer edge.

3. The pump of claim 2 further comprising stop means for limiting pivoting of said vanes.

4. The pump of claim 3 wherein said rotor includes a curved outer surface; and wherein each of said vanes includes an curved back surface corresponding in shape to said outer surface of said rotor.

5. The pump of claim 4 wherein said vane pockets include a curved cup portion; and wherein said vanes each include an end surface curved to match said cup portion.

6. A rotary pump, comprising;

a pumping chamber;

a rotor eccentrically positioned within said pumping chamber, said rotor defining a plurality of vane pockets and including a curved outer surface said vane pockets including a forward portion and a curved cup portion;

a plurality of vanes pivotally mounted on said rotor each within one of said vane pockets, each of said vanes having an inner edge, an outer edge, and a middle portion between said edges, each of said vanes being hinged to pivot about an axis extending through said middle portion, said axis for each of said vanes being closer to said inner edge than to said outer edge, said vanes including a curved back surface corresponding in shape to said outer surface of said rotor, said vanes further including a front surface extending from said inner edge to said outer edge, said vane pockets being shaped to allow pumpage to engage substantially all of said front surface, said vanes each further including an end surface curved to match said cup portion, said vanes each including a stop pin for engaging said forward portion to maintain a gap between said front surface and said forward portion; and a stop means for limiting pivoting of said vanes.

7. The pump of claim 6 wherein said stop means includes a limit pin located within said cup portion.

8. A rotor assembly for a hinged vane rotary pump, comprising:

a rotor defining a plurality of vane pockets and having a direction of rotation;

a plurality of vanes each having an inner portion, an outer portion, and a middle portion between said inner and outer portions, said vanes each including a front surface extending throughout said inner portion, said middle portion, and said outer portion, said vane pockets shaped to allow pumpage to engage substantially all of said front surface; and a plurality of hinge means for pivotally mounting one of said vanes within each of said vanes pockets, said hinge means allowing said vanes to pivot about an axis extending through said middle portion, said vanes oriented to fold into said direction of rotation when folding into the associated vane pocket.

9. The rotor assembly of claim 8 wherein said axis is closer to said inner portion than to said outer portion.

10. The rotor assembly of claim 9 further comprising stop means for limiting pivoting of each of said vanes.

11. The rotor assembly of claim 10 wherein said rotor includes a curved outer surface; and wherein each of said vanes includes an curved back surface corresponding in shape to said outer surface of said rotor.

12. The rotor assembly of claim 11 wherein said vane pockets include a curved cup portion; and wherein said vanes each include an end surface curved to match said cup portion.

13. A rotor assembly for a hinged vane rotary pump, comprising:

a rotor defining a plurality of vane pockets, said rotor including a curved outer surface, said vane pockets including a forward portion and a curved cup portion;

a plurality of vanes each having an inner portion, an outer portion, and a middle portion between said inner and outer portions, said vanes including a front surface extending throughout said inner portion, said middle portion, and said outer portion, said vane pockets shaped to allow pumpage to engage substantially all of said front surface, each of said vanes including a curved back surface corresponding in shape to said outer surface of said rotor, said vanes each further including an end surface curved to match said cup portion, said vanes each including a stop pin for engaging said forward portion to maintain a gap between said front surface and said forward portion;

a plurality of hinge means foe pivotally mounting one of said vanes within each of said vanes pockets, said hinge means allowing said vane to pivot about an axis extending through said middle portion, said axis being closer to said inner portion than to said outer portion; and stop means for limiting pivoting of each of said vanes.

14. The rotor assembly of claim 13 wherein said stop means includes a limit pin located within said cup portion.

15. A hinged vane rotary pump for pumping a pumpage, comprising:

a pump housing having a liner defining a pumping chamber;

a rotor assembly eccentrically and rotatably mounted within said pumping chamber, said rotor assembly having a direction of rotation and including a plurality of vane pockets and a single vane seated within each of said vane pockets, said vanes dividing said pumping chamber into a plurality of cavities, said vanes each having an inner edge toward said axis, an outer edge away from said axis, and a middle portion, said vanes each including a front surface extending from said inner edge to said outer edge, said vane pockets shaped to allow pumpage to engage substantially all of said front surface, each of said vanes hinged for pivotal movement at said middle portion and oriented to fold into said direction of rotation when folding into the associated van pocket; and drive means for rotating said rotor assembly within said pumping chamber.

16. The pump of claim 15 wherein said rotor assembly includes:

a shaft;

a rotor secured to said shaft, said rotor being generally cylindrical a pair of end discs fit to opposite longitudinal ends of said rotor; and wherein one of said vanes are pivotally supported in each of said vane pockets by said end discs.

17. The pump of claim 16 wherein said vanes are hinged to pivot inwardly and outwardly about an axis inward of said middle such that as said vanes wear during use said axis becomes said middle.

18. The pump of claim 17 further comprising a stop means for limiting outward pivot of said vanes.

19. The pump of claim 18 wherein said end discs each includes a curved outer surface; and wherein each of said vanes includes an curved back surface corresponding in shape to said outer surface of said end discs.

20. The pump of claim 19 wherein said vane pockets include a curved cup portion; and wherein said vanes each include an end surface curved to match said cup portion.

21. A hinged vane rotary pump for pumping a pumpage, comprising:

a pump housing having a liner: defining a pumping chamber;

a rotor assembly eccentrically and rotatably mounted within said pumping chamber, said rotor assembly including a shaft and a rotor secured to said shaft, said rotor being generally cylindrical and defining a plurality of vane pockets, said vane pockets including a curved cup portion, said rotor assembly further including a pair of end discs fit to opposite longitudinal ends of said rotor and a plurality of vanes dividing said pumping chamber into a plurality of cavities, said end discs each including a curved outer surface, one of said vanes pivotally supported in each of said vane pockets by said end discs, said vanes each having an inner edge toward said axis, an outer edge away from said axis, and a middle, each of said vanes hinged to pivot inwardly and outwardly about an axis inward of said middle such that as said vanes wear during use said axis becomes said middle, each of said vanes further including a curved back surface corresponding in shape to said outer surface of said end discs, an end surface curved to match said cup portion, and a front surface, and said vane pockets include a forward portion, said vanes each including a stop pin for engaging said forward portion to maintain a gap between said front surface and said forward portion;

drive means for rotating said rotor assembly within said pumping chamber; and stop means for limiting outward pivot of said vanes.

22. The pump of claim 22 wherein said stop means includes a limit pin mounted to one of said end discs, said limit pin located within said cup portion.

23. The pump of claim 22 wherein said hinge means includes a hinge pin extending from said vane, said hinge pin being rotatably supported by at least one of said end discs.

* * * * *

UNITED STATES PATENT AND TRADEMARK OFFICE

CERTIFICATE OF CORRECTION

PATENT NO. : 5,571,005

DATED : November 5, 1996

INVENTOR(S) : Thomas D. Stoll et al

It is certified that error appears in the above-indentified patent and that said Letters Patent is hereby corrected as shown below:

Column 7, Claim 6, Line 25:
After "surface" insert --,--

Column 8, Claim 13, Line 28:
"foe" should be --for--

Column 9, Claim 21, Line 18:
After "liner" delete --:--

Column 10, Claim 22, Line 19:
"22" should be --21--

Signed and Sealed this

Fourth Day of March, 1997

*Attest:*

*Attesting Officer*

BRUCE LEHMAN

*Commissioner of Patents and Trademarks*